US011417488B2

(12) United States Patent
Beuchelt

(10) Patent No.: US 11,417,488 B2
(45) Date of Patent: Aug. 16, 2022

(54) VOLTAGE LIMITING DEVICE

(71) Applicant: Rail Power Systems GmbH, Munich (DE)

(72) Inventor: Julian Beuchelt, Eppstein (DE)

(73) Assignee: Rail Power Systems GmbH

( * ) Notice: Subject to any disclaimer, the term of this patent is extended or adjusted under 35 U.S.C. 154(b) by 484 days.

(21) Appl. No.: 16/534,640

(22) Filed: Aug. 7, 2019

(65) Prior Publication Data

US 2020/0058459 A1 Feb. 20, 2020

(30) Foreign Application Priority Data

Aug. 16, 2018 (EP) ..... 18189372

(51) Int. Cl.

| | |
|---|---|
| ***H01H 71/02*** | (2006.01) |
| ***H01H 71/08*** | (2006.01) |
| ***H01H 79/00*** | (2006.01) |
| *H01H 71/24* | (2006.01) |

(52) U.S. Cl.

CPC ..... *H01H 71/025* (2013.01); *H01H 71/0214* (2013.01); *H01H 71/08* (2013.01);

(Continued)

(58) Field of Classification Search

CPC ..... B60M 5/02; H01H 50/14; H01H 50/021; H01H 2223/008; H01H 79/00; H01H 9/02;

(Continued)

(56) References Cited

U.S. PATENT DOCUMENTS

| | | | | |
|---|---|---|---|---|
| 9,705,316 | B2 | 7/2017 | Muehlschlegel | |
| 2013/0154774 | A1* | 6/2013 | Bhavaraju | H01H 47/32 335/127 |
| 2013/0279085 | A1* | 10/2013 | Wang | H01H 85/20 361/642 |

FOREIGN PATENT DOCUMENTS

| | | | |
|---|---|---|---|
| AU | 2014204920 | A1 | 7/2015 |
| CN | 101707358 | A | 5/2010 |

(Continued)

OTHER PUBLICATIONS

EPO search report of corresponding European priority application No. 18 189 372.8, dated Feb. 2, 2019, 9 pages (not prior art).

Office Action of corresponding China Patent Application No. 201910754875.3, dated Jun. 7, 2021, including the translation totals 14 pages (not prior art).

*Primary Examiner* — Bryan R Perez

(74) *Attorney, Agent, or Firm* — Lucian Wayne Beavers; Pattterson Intellectual Property Law, PC

(57) ABSTRACT

The invention relates to a voltage limiting device which has an electromagnetically operable switching device for producing an electrical connection between a first cable terminal and a second cable terminal wherein a first electrical conductor connects the first cable terminal to the one terminal of the switching device and a second electrical conductor electrically connects the second cable terminal to the other terminal of the switching device. The voltage limiting device is characterized in that one of the two electrical conductors comprises an electrically conductive support plate. The expansion of the support plate in the width direction allows, in contrast to an electrical conductor which is characterized by a small width in relation to the length, a current displacement in the width direction. As a result, the forces acting on the conductive parts of the switching device are reduced and the switching contacts are relieved, as a result of which the electrical properties of the voltage limiting device are improved. As an electrical conductor, the (Continued)

support plate improves not only the electrical properties of the voltage limiting device, but as a mounting plate also simplifies the assembly and mounting of the individual components of the voltage limiting device.

20 Claims, 6 Drawing Sheets

(52) U.S. Cl.
CPC ..... *H01H 79/00* (2013.01); *H01H 71/0271* (2013.01); *H01H 71/2454* (2013.01); *H01H 2223/008* (2013.01)

(58) Field of Classification Search
CPC .. H01H 71/025; H01H 71/0214; H01H 71/08; H01H 71/027; H01H 71/2454
See application file for complete search history.

(56) References Cited

FOREIGN PATENT DOCUMENTS

| | | | |
|---|---|---|---|
| CN | 203553023 | U | 4/2014 |
| CN | 203660293 | U | 6/2014 |
| CN | 203660333 | U | 6/2014 |
| CN | 105782929 | A | 7/2016 |
| CN | 205583501 | U | 9/2016 |
| CN | 207200050 | U | 4/2018 |
| CN | 108110626 | A | 6/2018 |
| CN | 207530421 | U | 6/2018 |
| CN | 207719708 | U | 8/2018 |
| DE | 102013200254 | A1 | 7/2014 |
| DE | 102015200186 | A1 | 7/2016 |
| EP | 3287312 | A1 | 2/2018 |
| JP | 1995-264734 | A | 10/1995 |
| JP | 1998-094120 | A | 4/1998 |
| JP | 2011-97719 | A | 5/2011 |

* cited by examiner

VOLTAGE LIMITING DEVICE

CROSS-REFERENCE TO RELATED APPLICATION

This application claims benefit of European Patent Application No. 18189372.8, filed Aug. 16, 2018, which is hereby incorporated by reference.

BACKGROUND

The invention relates to a voltage limiting device comprising an electromagnetically operable switching device for producing an electrical connection between a first cable terminal and a second cable terminal.

Voltage limiting devices (VLD=Voltage Limiting Device) are used in the field of rail energy supply, in particular in the field of DC-powered railways. In DC-powered railways, the rail is usually used as a return conductor for the traction current. In this case, the rail is insulated against ground to prevent stray currents from happening. Due to the electrical resistance of the rail, the return current flowing through the rail results in a potential difference with respect to ground, which can be tapped as a voltage between rail and earth. In order to avoid impermissible contact voltages which can occur during operation or in the event of a fault, protective measures are prescribed which are very often carried out in the form of voltage limiting devices. In this case, voltage limiting devices of the self-resettable grounding short-circuiter sub-type are operationally advantageous. These are generally installed between the rail and the grounding system and respond at a defined contact voltage threshold.

Known voltage limiting devices have a switching device that establishes an electrical connection between two cable terminals. The switching devices have a single-pole or multi-pole contactor with a fixed and a movable switching contact actuated by an electromagnetic actuator. The contactor can be operated together with thyristors which are in an arbitrary temporal triggering relationship with the contactor. After the thyristors have been triggered, the contactor can take over the load. For triggering the contactor or the thyristors, at least one control device and/or control electronics unit are provided. Often the components are located in a control cabinet.

For a standardised design, the contactor must be able to carry the current at a certain power level for a certain period of time. If the current becomes too high, technical measures must be taken to reinforce or relieve the switching contacts of the contactor.

SUMMARY

The object of the invention is to provide a voltage limiting device that allows higher switching performance while maintaining the same dimensions.

This object is achieved according to the invention by the features of the independent claims. The subject matter of the dependent claims relates to advantageous embodiments of the invention.

The voltage limiting device according to the invention comprises an electromagnetically-operable switching device for producing an electrical connection between a first cable terminal and a second cable terminal, wherein an electrical conductor electrically connects the first cable terminal with one terminal of the switching device and another electrical conductor electrically connects the second cable terminal with the second connection of the switching device. The two electrical conductors may each have a plurality of conductive parts. The voltage limiting device is characterized in that one of the two electrical conductors comprises an electrically conductive support plate which can at the same time serve as a mounting plate for at least parts of the other electrical conductor. The cable terminals can each have one or more cable lugs or the like in order to be able to connect one or more cables to a cable terminal.

In this context, an electrically conductive support plate is understood to mean a flat component which is different from a component which has only a relatively small width in relation to the length thereof, i.e. which is different from a narrow component such as a rail-shaped conductor. In contrast to an electrical conductor, which is characterized by a width which is small in relation to the length, the extension of the support plate in the direction of the width allows a current displacement in the width direction. Since the current conductor is drawn out width-wise, current can be displaced in a direction other than in the direction of the switching device, preferably in the opposite direction. It has been found that, in this way, the forces acting on the conductive parts of the switching device, in particular the switching contacts thereof, are reduced and the switch contacts are relieved. This improves the electrical properties of the voltage limiting device. The voltage limiting device can switch higher loads without having to reinforce the contacts of the switching device.

As an electrical conductor, the support plate not only improves the electrical properties of the voltage limiting device, but also simplifies the arrangement and attachment of the individual components of the voltage limiting device.

In the voltage limiting device according to the invention, the support plate can facilitate the installation of at least parts of the electrical conductor, which does not comprise the support plate, whereby this electrical conductor can be easily attached to the electrically-conductive support plate by means of an insulator, or at least parts of this conductor can be attached to the electrically-conductive support plate thereby. As a result, a tight spatial arrangement of the individual components is possible using the space provided in the cabinet so that a compact design of the voltage limiting device can be achieved.

The voltage limiting device can be disposed in a conventional control cabinet having a front and a back, a left side part and right-side part and a top part and a bottom part. In the control cabinet, the electrically conductive support plate is preferably disposed at the back, so that individual components of the voltage limiting device can be disposed in front of the support plate and fastened to the support plate. The support plate may form at least a part of the rear wall of the cabinet. Preferably, the support plate is the rear wall of the cabinet. But it can also form at least a part of a rear wall of the cabinet which is not the rear wall of the cabinet. In this case, a panel or the like may be provided behind the support plate, which forms the rear part of the cabinet. However, the support plate can also be disposed in the area of one of the two side parts of the cabinet. Here, the support plate may also be at least a part of the side part.

The support plate is made of an electrically conductive material, which may be copper or aluminium. In practice, the less expensive aluminium is sufficient.

The conductor, which does not comprise the electrically conductive support plate, preferably comprises a busbar for establishing an electrical connection between the cable terminal and the switching device. However, this current path can also comprise other conductive parts.

A preferred embodiment provides that the busbar of the conductor which does not comprise the electrically conductive support plate and the electrically conductive support plate itself are disposed in the cabinet in different levels, i.e. one after the other or one above the other depending on the line of sight. The support plate is preferably disposed in a rear area of the cabinet and the busbar of the conductor which does not comprise the electrically conductive support plate is disposed in a front area of the cabinet, such that a sufficient distance is present between the current-carrying parts. This busbar and the cable terminal electrically connected to this busbar are preferably disposed in a single plane. The busbar and cable terminal are preferably disposed in a front area of the cabinet.

A further preferred embodiment provides that the conductor comprising the electrically conductive support plate has a busbar which extends from the plane in which the electrically conductive support plate lies to the plane in which the switching device lies. The switching device can thus be disposed in front of the support plate. Preferably, the switching device is attached to a support rail extending between the left and right-side part of the cabinet.

The switching device is preferably disposed in the control cabinet in front of the support plate in the area of one of the two side parts of the cabinet. In this case, the switching device is preferably disposed in the control cabinet above the first and second cable terminals.

One of the two cable terminals is electrically-conductively attached to the electrically conductive support plate. This cable terminal and the electrically conductive support plate are preferably connected to ground potential.

The switching device preferably has a contactor with one or more switching poles connected in parallel and each having a switching contact pair. One contact of the switching pole can be a fixed contact and the other contact can be a movable contact. In a multi-pole contactor, one electrical conductor connects one cable terminal electrically to the fixed switching contacts of the switching poles, and the other electrical conductor connects the other cable terminal to the movable switching contacts of the switching poles.

BRIEF DESCRIPTION OF THE DRAWINGS

An embodiment of the invention is explained in more detail below with reference to the drawings.

Shown are.

DETAILED DESCRIPTION

Figure 1:
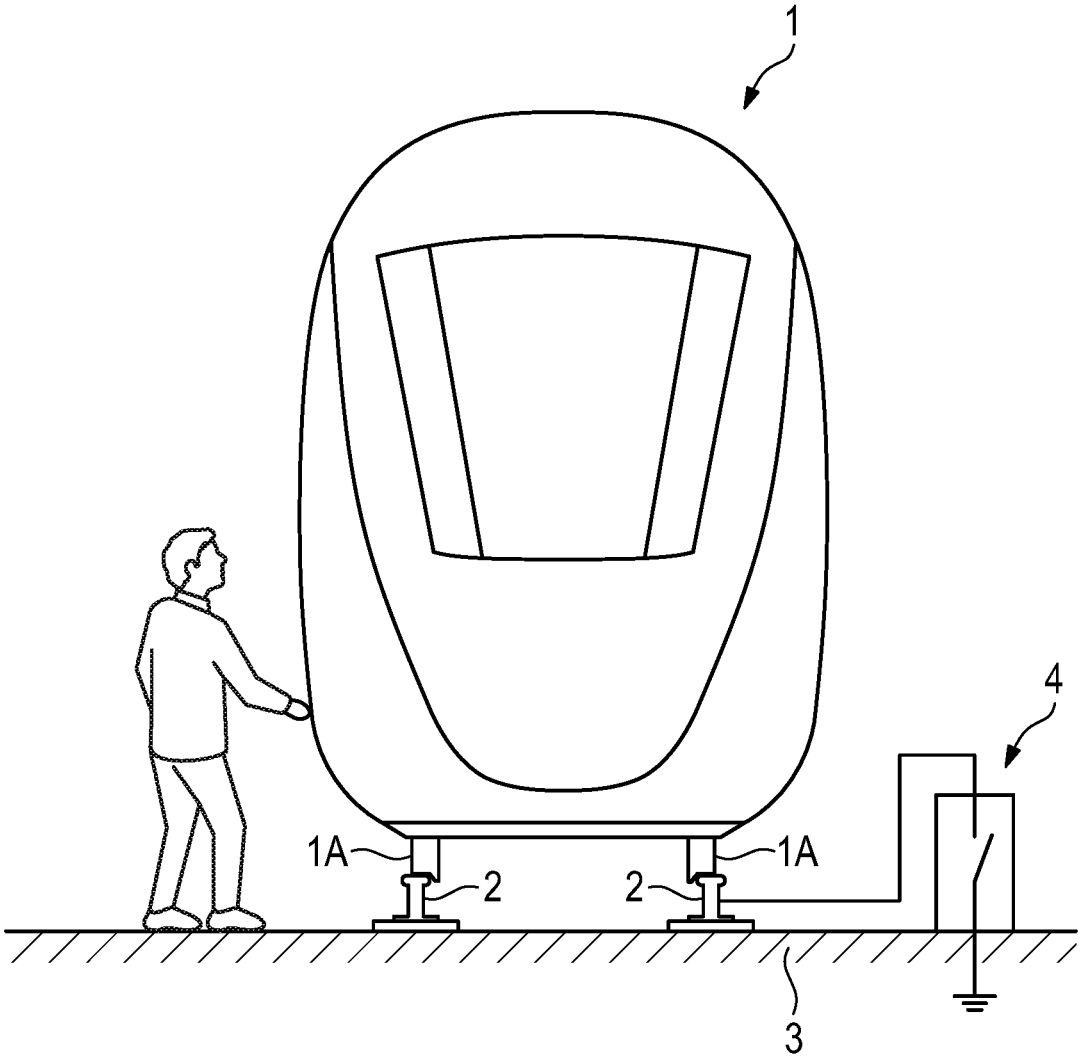
FIG. 1 a rail vehicle and the voltage limiting device in a highly simplified schematic representation, FIG. 2 the components of the voltage limiting device in a schematic representation, FIG. 3 a control cabinet in a greatly simplified, partially sectional perspective view, wherein, in the cabinet, only the operating and control unit of the voltage limiting device is shown, FIG. 4 a front view of the cabinet of the voltage limiting device of FIG. 3, FIG. 5 a side view of the cabinet of the voltage limiting device of FIG. 3 and FIG. 6 an electrical equivalent circuit diagram for illustrating the current displacement in the electrically conductive support plate of the voltage limiting device.

FIG. 1 shows a DC-powered rail vehicle together with the voltage limiting device according to the invention. The rail vehicle 1 has wheels 1A, which run on a rail 2. The rail 2 of the railway system is insulated from the ground 3. The electrical resistance of the rail 2 results in the occurrence of a potential difference between the rail vehicle 1 or the rail 2 and the ground 3. The voltage limiting device 4 prevents the occurrence of impermissible contact voltages during normal railway operation or in the event of an error (short circuit). The voltage limiting device 4 is installed between the rail 2 and the grounding system and can establish an electrical connection between the rail 2 and ground 3 (grounding short-circuiter). The voltage limiting device 4 may also be referred to as a voltage limiting apparatus 4.

Figure 2:
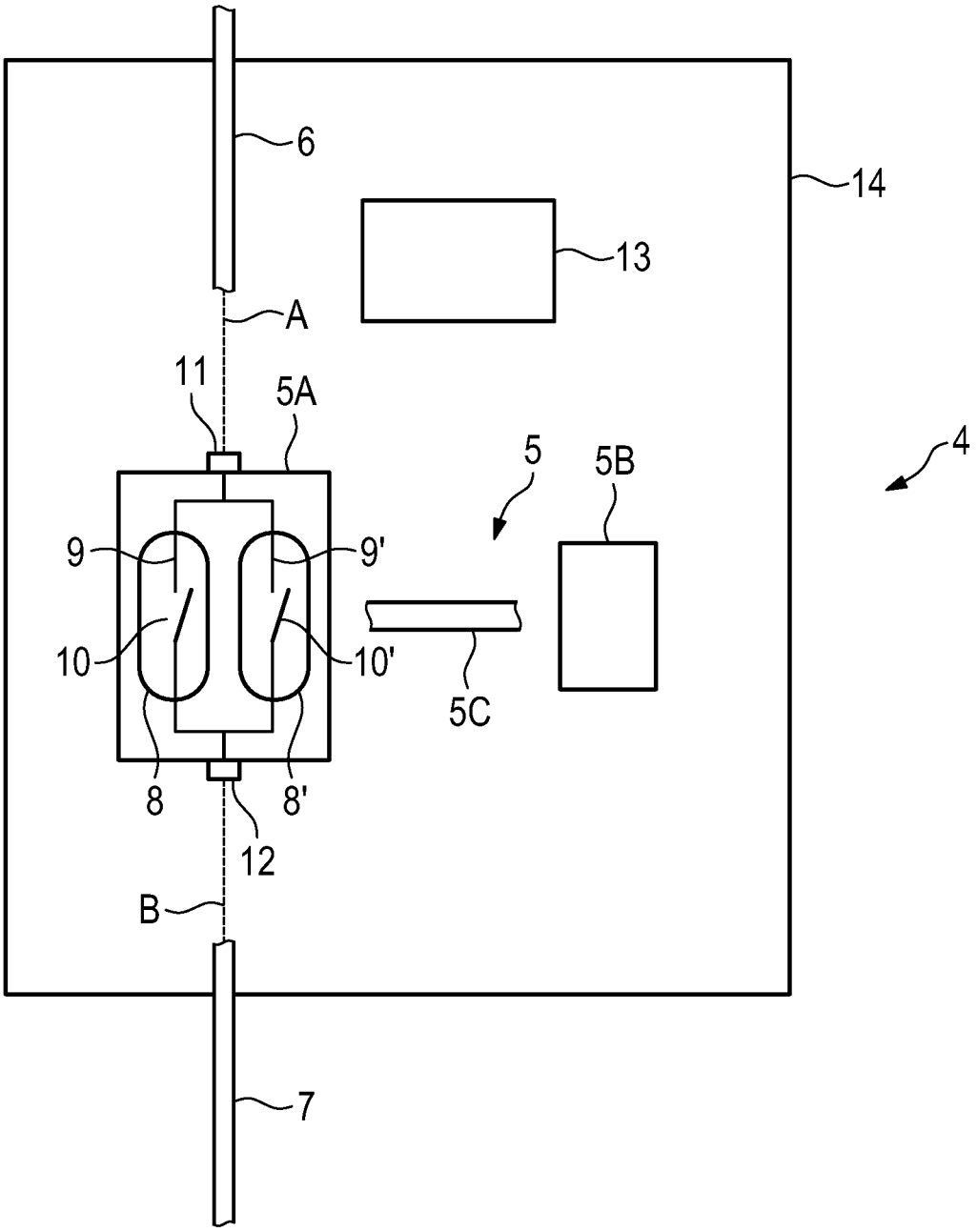

FIG. 2 shows the components of the voltage limiting device 4 in a highly simplified schematic representation. The voltage limiting device 4 comprises a switching device 5 for producing an electrical connection between one or more cables 7 which lead to a component or an assembly—not shown—of the rail energy supply system, such as rail 2, and one or more cables 6 which are connected to the grounding system—not shown—, or to other metallic components to be protected. The switching device 5 may also be referred to as a switch 5.

The switching device 5 has a single-pole or multi-pole contactor 5A, which belongs to the prior art. In the present embodiment, the contactor 5A comprises two parallel switching poles 8, 8', each having a fixed switching contact 9, 9' and a movable switching contact 10, 10'. The fixed switching contacts 9, 9' are electrically connected to one terminal 11 of the contactor 5, and the movable switching contacts 10, 10' are electrically connected to the other terminal 12 of the contactor 5A.

The contactor 5A may also have other components, such as a so-called arc blowout chimney, which belong to the prior art. To actuate the movable switching contacts 10, 10', the switching device 5 comprises an electromagnetic actuator unit 5B, which may have various components such as a coil and a magnetic armature to actuate a shaft 5C by means of which the movable switching contacts 10, 10' are moved. The arrangement here is arbitrary.

The electrical connection between one terminal 11 of the contactor 5A and cable 6 is affected by means of conductor A, and the electrical connection between the other terminal 12 of the contactor 5A and cable 7 is effected by means of conductor B.

In addition, the voltage limiting device 4 can also comprise an operating and/or control unit 13, which can form a common assembly. These components as well as other components of the voltage limiting device, which are not shown, are located in a control cabinet 14 which should have the smallest possible dimensions.

Figure 3:
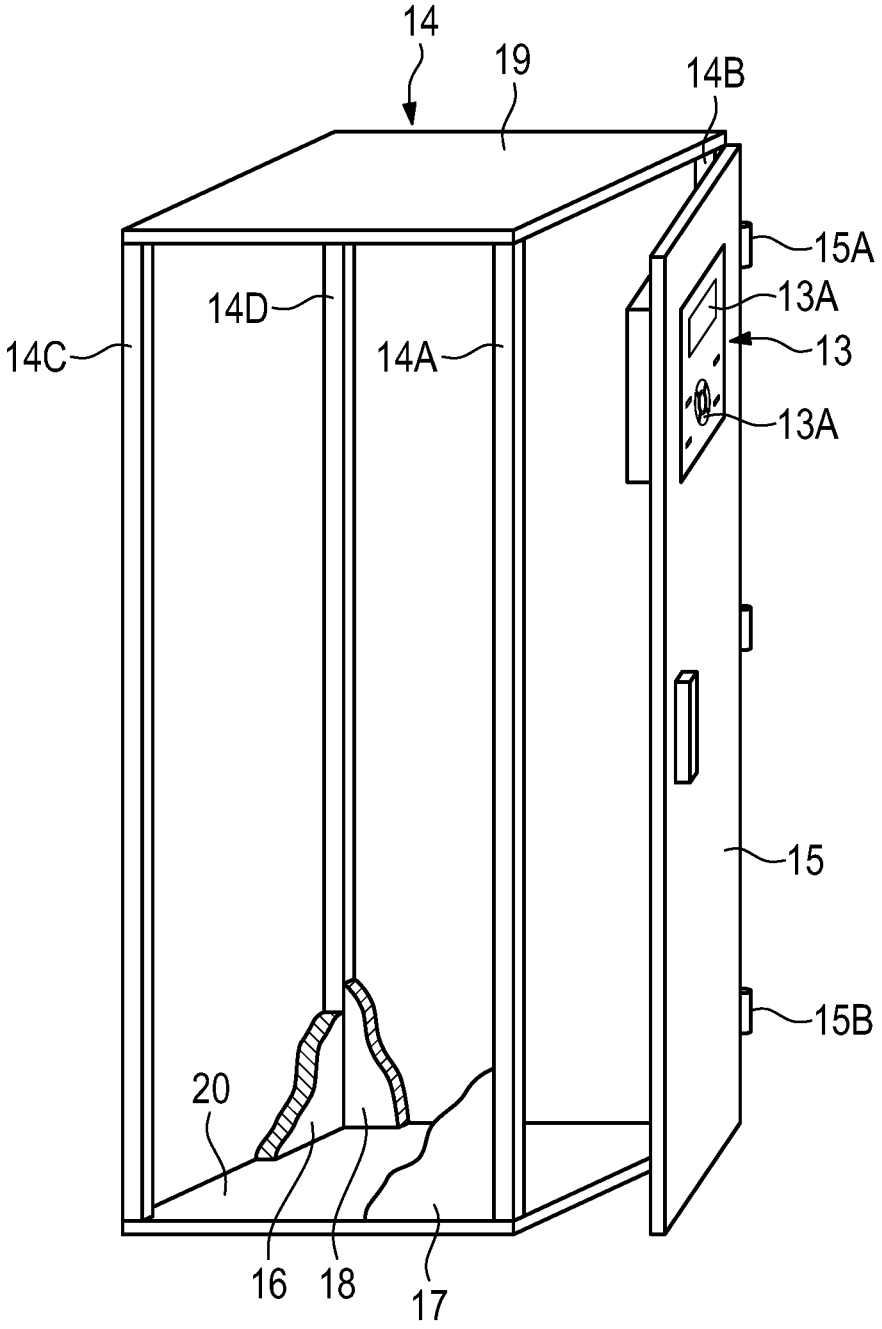

FIG. 3 shows a view of the cabinet 14 in a simplified perspective view. In the position shown in FIG. 3, the control cabinet 14 has four vertical profile bars 14A, 14B, 14C, and 14D to which a front part 15, a rear part 16, a left side part 17, a right-side part 18, a top part 19 and a bottom part 20 are attached. The front part 15 is a pivotable door which is fixed to side hinges 15A, 15B on the right side of the cabinet 14.

Figure 4:
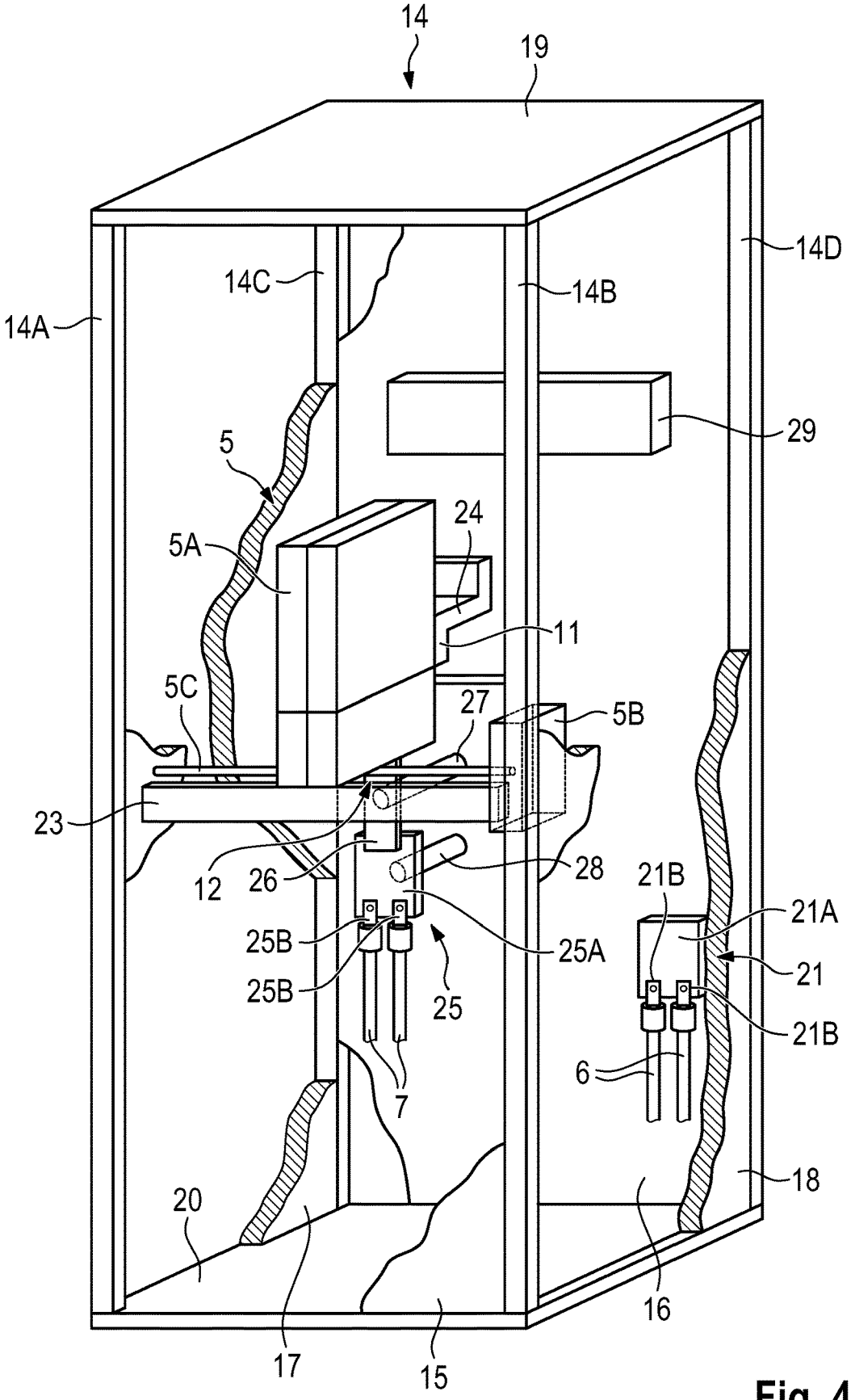
Figure 5:
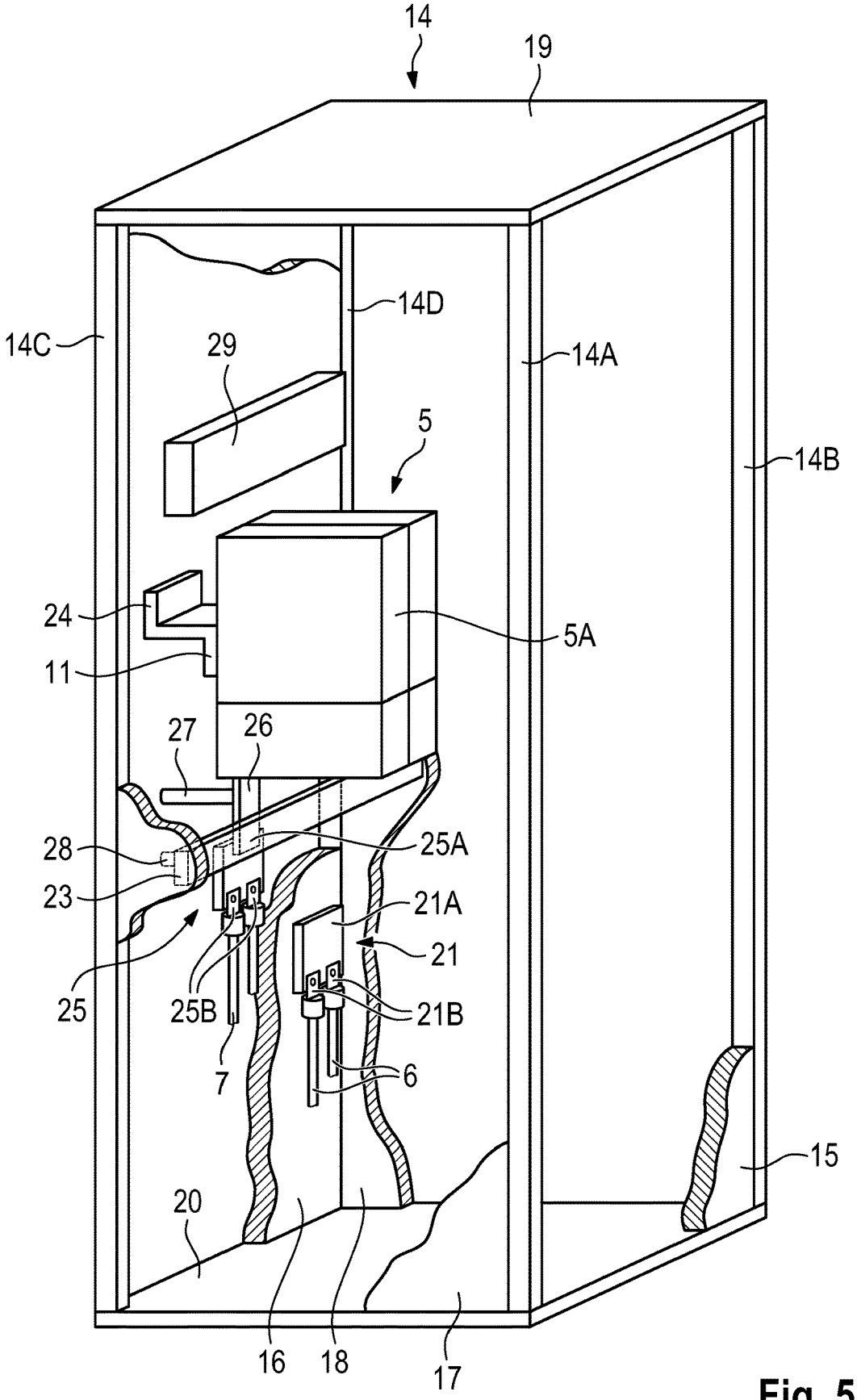

The arrangement of the individual components of the voltage limiting device 4 in the control cabinet 14 will be described below with reference to FIGS. 3 to 5. The parts of FIG. 2 are denoted by the same reference signs in FIGS. 3 to 5.

The operating and control unit 13 of the voltage limiting device 4 is inserted into the upper part of the door 15 of the control cabinet 14, so that the operating elements 13A are accessible from the outside. The rear part of the operating and control unit 13 extends into the upper half of the cabinet 14.

The rear part 16 of the cabinet 14, i.e. the rear wall thereof, is a metal plate, preferably made of aluminium, which functions as both an electrically conductive support plate and a mounting plate. In the present exemplary embodiment, a cable terminal 21 is fastened to the support plate 16 on the right side in the lower area of the control cabinet, the cable terminal comprising a connection plate 21A, preferably a copper plate, which is electrically-conductively connected to the support plate 16, with two cable lugs 21B in the present embodiment, to each of which a connecting cable 6 is connected which leads to a grounding system, not shown.

The contactor 5A and the actuator 5B of the switching device 5 of the voltage limiting device 4 are fastened in the upper half of the cabinet 14 to a support rail 23 (for example, called bars) extending between the left and right-side part 17, 18 of the cabinet 14. Contactor 5A and actuator 5B are at a sufficient distance from the electrically conductive support plate 16, which is the rear wall of the cabinet in the present embodiment and lie in a plane parallel to the support plate. The horizontal actuating shaft 5C extends in this plane between the contactor 5A and the actuator 5B.

One terminal 11 of the contactor 5A is electrically connected to the support plate 16. The electrical connection to the support plate 16 is achieved by means of a bus bar 24, for example a Z-shaped, L-shaped or U-shaped copper rail with a sufficient cross section which extends from the support plate 16 to the one terminal 11 of the contactor 5A in the front plane of the cabinet 14. The other terminal 12 of the contactor 5A is electrically connected to the other cable terminal 25 which comprises a terminal plate 25A, preferably a copper plate, in the present embodiment with two cable lugs 25B, for connecting two connecting cables 7. The electrical connection to this cable terminal 25 is achieved by means of a busbar 26, preferably a flat copper rail with a sufficient cross section. This bus bar 26 and this cable terminal 25 are disposed in the front plane at a sufficient distance from the support plate 16. The bus bar 26 is fastened to the support plate using an insulator 27, and the terminal plate 25A of the cable terminal 25 is fixed to the support plate using an insulator 28.

In the control cabinet, further components of the voltage limiting device may be provided. One of these components is designated by the reference sign 29 in the figures.

In the present embodiment, the contactor 5A is disposed on the left side, and the actuator 5B is disposed on the right side of the cabinet 14. However, the contactor and related connection components can also be disposed on the right side and the actuator disposed on the left side of the cabinet.

The electrically conductive support plate 16 serves as conductor A for the flow of current from the one cable terminal 21 to the one terminal 11 of the switching device 5A. From the other terminal 12 of the switching device 5A, the current flows by way of the bus bar 26 to the other cable terminal 25. However, the support plate 16 serves not only as an electrical conductor but can also be used as a mounting plate for the bus bar 26 of conductor B, which does not comprise the support plate, and for terminal plate 25A of the other cable terminal 25. As a result, assembly is simplified, and a compact design is achieved. In addition, other secondary components, such as clamps or relays, can be mounted on the support plate.

A decisive advantage of the electrically conductive support plate 16 is that, due to the current displacement in the support plate 16, the switching contacts 9, 9' and 10, 10' of the contactor 5A are relieved.

Figure 6:
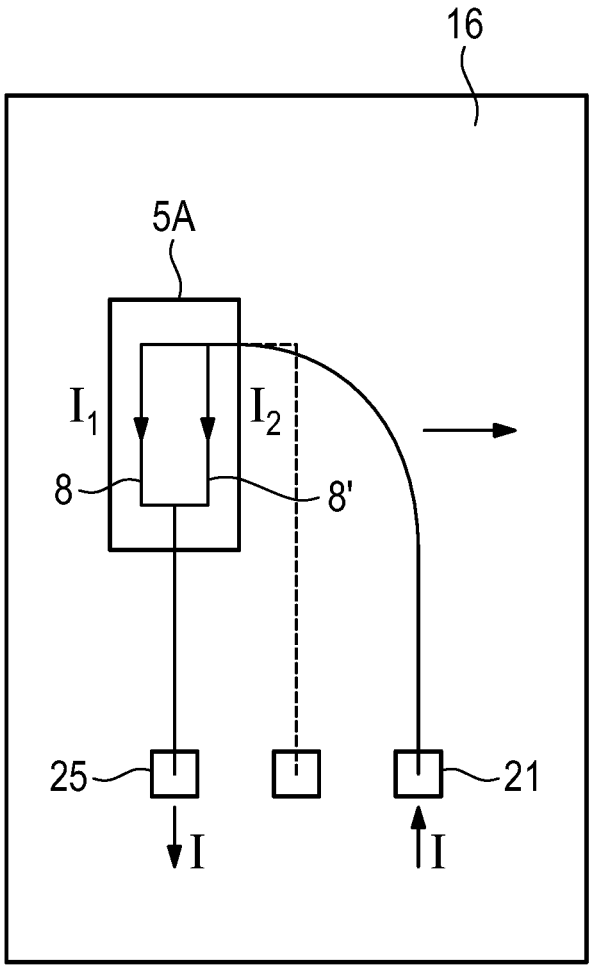

FIG. 6 shows the current flow through the bipolar contactor 5A and the support plate 16. The current flow in this document will be explained with reference to a current flow direction. In practice, bi-directional (in both directions) current flows are possible, with the illustrated principle being applied accordingly. In the present embodiment, it is assumed that the current I flows from the one cable terminal 21 through the support plate 16 to the one terminal 11 of the contactor 5A, through the two parallel switching poles 8, 8' of the contactor 5A to the other terminal 12 of the contactor and through the bus bar 26 to the other cable terminal 25. In the above-described spatial arrangement of the individual components, the currents $I_1$ and $I_2$ in the conductive parts of the two switching poles 8, 8' flow in the same direction. The current I in the support plate 16 and the currents $I_1$ and $I_2$ in the two switching poles flow in the opposite direction.

The voltage limiting device according to the invention differs from the known voltage limiting devices in particular in that the current to the one terminal of the switching device does not flow through a narrow electrical conductor (busbar), which extends in close spatial proximity to the switching device, but rather flows through the support plate.

Due to the current flow through a narrow electrical conductor (busbar) in a voltage limiting device according to the prior art, which is indicated by a dashed line in FIG. 6, electromagnetic forces that cause the current I flowing through the contactor of the switching device in the direction of the switching pole 8 outside on the left in FIG. 6 to be displaced act on the electrically-conductive parts of the switching poles 8, 8' of the contactor 5A, in particular on the switching contacts 10, 10' thereof, wherein it is assumed that no current displacement occurs in the narrow electrical conductor (busbar), which acts as a "fixed electrical conductor". Consequently, the current $I_1$ is greater than the current $I_2$. As a result of the higher current flow, greater forces act on the switching contacts of the left switching pole 8, which cause the forces required to close this switch to be greater. Consequently, this switch must be made larger, for example the spring assemblies thereof must be designed stronger in order to ensure proper closing of the switch. Otherwise, because of the high currents, there is a risk that the switch will burn away when closing or conducting the current.

In contrast, in the voltage limiting device according to the invention instead of the narrow electrical conductor (busbar), the electrically conductive support plate is provided. In the voltage limiting device according to the invention, a current displacement occurs in the support plate 16. In FIG. 6, the current flow through the support plate is indicated by a solid line. The current displacement takes place in the opposite direction as the contactor 5A, which is indicated in FIG. 6 by an arrow. It has been shown that owing to the current displacement in the support plate 16, the strength of current $I_1$ of the current flowing through the outer, left switching pole 8 largely corresponds to the strength of current $I_2$ of the current flowing through the inner, right switching pole 8'. Due to the current displacement in the support plate 16, smaller electromagnetic forces act on the switching contacts 10, 10' of the contactor 5A so that the switching contacts thereof are relieved. Therefore, the switching contacts can be dimensioned to be weaker.

The invention claimed is:

1. A voltage limiting apparatus, comprising:

a first cable terminal;

a second cable terminal;

an electromagnetically operable switch configured to produce an electrical connection between the first cable terminal and the second cable terminal;

a first electrical conductor electrically connecting the first cable terminal to the switch;

a second electrical conductor electrically connecting the second cable terminal to the switch; and wherein the first electrical conductor includes an electrically conductive support plate configured to serve as a conductor for the flow of current through the first electrical conductor.

2. The voltage limiting apparatus of claim 1, wherein:

the first cable terminal is electrically conductively attached to the electrically conductive support plate.

3. The voltage limiting apparatus of claim 2, wherein:

the first cable terminal and the electrically conductive support plate are connected to a ground potential.

4. The voltage limiting apparatus of claim 1, further comprising:

a control cabinet; and wherein the switch is disposed in the cabinet above the first and second cable terminals.

5. The voltage limiting apparatus of claim 1, wherein:

the second electrical conductor is fastened to the electrically conductive support plate with at least one insulator.

6. The voltage limiting apparatus of claim 1, further comprising:

a control cabinet including a front part, a rear part, a left side part, a right side part, a top part and a bottom part.

7. The voltage limiting apparatus of claim 1, wherein:

the electrically conductive support plate is made of aluminum.

8. The voltage limiting apparatus of claim 1, wherein:

the second electrical conductor includes a busbar electrically connected to the second cable terminal.

9. The voltage limiting apparatus of claim 1, wherein:

the switch is disposed in a plane extending parallel to the electrically conductive support plate.

10. The voltage limiting apparatus of claim 1, wherein:

the first electrical conductor includes a busbar extending from a plane in which the electrically conductive support plate is disposed to a plane in which the switch is disposed.

11. The voltage limiting apparatus of claim 1, further comprising:

a control cabinet including a front part, a rear part, a left side part, a right side part, a top part and a bottom part; and a mounting rail extending between the left side part and the right side part; and wherein the switch is fastened to the mounting rail.

12. The voltage limiting apparatus of claim 1, wherein:

the switch includes a plurality of parallel switching poles, each switching pole including two switching contacts.

13. A voltage limiting apparatus, comprising:

a first cable terminal;

a second cable terminal;

an electromagnetically operable switch configured to produce an electrical connection between the first cable terminal and the second cable terminal;

a first electrical conductor electrically connecting the first cable terminal to the switch;

a second electrical conductor electrically connecting the second cable terminal to the switch;

a control cabinet including a front part, a rear part, a left side part, a right side part, a top part and a bottom part;

wherein the first electrical conductor includes an electrically conductive support plate;

wherein the rear part of the control cabinet includes a rear wall; and wherein the electrically conductive support plate forms at least a part of the rear wall of the control cabinet.

14. A voltage limiting apparatus, comprising:

a first cable terminal;

a second cable terminal;

an electromagnetically operable switch configured to produce an electrical connection between the first cable terminal and the second cable terminal;

a first electrical conductor electrically connecting the first cable terminal to the switch;

a second electrical conductor electrically connecting the second cable terminal to the switch;

a control cabinet;

wherein the first electrical conductor includes an electrically conductive support plate;

wherein the second electrical conductor includes a busbar electrically connected to the second cable terminal;

wherein the busbar and the electrically conductive support plate are disposed in different planes in the cabinet.

15. The voltage limiting apparatus of claim 14, wherein:

the busbar and the second cable terminal are disposed in one plane.

16. A voltage limiting apparatus, comprising:

a first cable terminal;

a second cable terminal;

an electromagnetically operable switch configured to produce an electrical connection between the first cable terminal and the second cable terminal;

a first electrical conductor electrically connecting the first cable terminal to the switch;

a second electrical conductor electrically connecting the second cable terminal to the switch;

wherein the first electrical conductor includes an electrically conductive support plate; and wherein the electrically conductive support plate is a flat plate and the first cable terminal is mounted on the electrically conductive support plate at a location laterally offset from the switch.

17. The voltage limiting apparatus of claim 16, wherein:

current flowing from the switch through the electrically conductive support plate to the first cable terminal flows in a direction having a substantial component of direction laterally away from the switch.

18. A voltage limiting apparatus, comprising:

a cabinet including a plurality of walls;

a first cable terminal located within the cabinet;

a second cable terminal located within the cabinet;

an electromagnetically operable switch located within the cabinet and configured to produce an electrical connection between the first cable terminal and the second cable terminal;

a first electrical conductor electrically connecting the first cable terminal to the switch, the first electrical conductor including an electrically conductive support plate forming at least a part of one of the walls of the cabinet;

a second electrical conductor electrically connecting the second cable terminal to the switch;

wherein the first cable terminal is electrically conductively attached to the support plate; and wherein the second electrical conductor includes a busbar electrically connected to the second cable terminal, and the busbar is fastened to the electrically conductive support plate with at least one insulator.

19. The voltage limiting apparatus of claim 18, wherein:

the first cable terminal is mounted on the electrically conductive support plate at a location laterally offset from the switch such that current flowing from the switch through the electrically conductive support plate to the first cable terminal flows in a direction having a substantial component of direction laterally away from the switch.

20. The voltage limiting apparatus of claim 18, wherein:

the first electrical conductor includes another busbar extending from a plane in which the electrically conductive support plate is disposed to a plane in which the switch is disposed; and the switch is disposed in the cabinet above the first and second cable terminals.

* * * * *